US007083451B2

(12) United States Patent
Zhu et al.

(10) Patent No.: US 7,083,451 B2
(45) Date of Patent: Aug. 1, 2006

(54) STACKED ELECTRICAL CONNECTOR

(75) Inventors: ZiQiang Zhu, Kunsan (CN); Guohua Zhang, Kunsan (CN); WenKe He, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/175,067

(22) Filed: Jul. 5, 2005

(65) Prior Publication Data

US 2006/0009084 A1 Jan. 12, 2006

(30) Foreign Application Priority Data

Jul. 6, 2004 (CN) ..... 2004 2 0062553

(51) Int. Cl.
*H01R 29/00* (2006.01)

(52) U.S. Cl. ..... 439/188

(58) Field of Classification Search ..... 439/188, 439/189; 200/51.09
See application file for complete search history.

(56) References Cited

U.S. PATENT DOCUMENTS

| | | | | |
|---|---|---|---|---|
| 5,700,164 | A | 12/1997 | Weidler et al. | |
| 5,738,544 | A | 4/1998 | Davis | |
| 5,800,192 | A * | 9/1998 | David et al. | 439/188 |
| 6,059,578 | A * | 5/2000 | Arnett | 439/43 |
| D465,768 | S | 11/2002 | Zhu et al. | |
| 6,739,892 | B1 * | 5/2004 | Belopolsky et al. | 439/188 |

* cited by examiner

*Primary Examiner*—Phuong Dinh
(74) *Attorney, Agent, or Firm*—Wei Te Chung

(57) ABSTRACT

An electrical connector (1) has a first port (11) with a number of first terminals (21) received therein, a second port (12) with a number of second terminals (22) received therein, a number of third terminals (23) located between the first and second terminals and a moveable port switch (30) assembled to the first and second ports. Each of said first and second terminals defines a tail portion (212, 222) extending outside the first and second ports, respectively. The port switch can drive the tail portions of the first and second terminals to electrically connect with the third terminals, respectively and alternately.

20 Claims, 9 Drawing Sheets

STACKED ELECTRICAL CONNECTOR

BACKGROUND OF THE INVENTION

1. Field of the Invention

The present invention relates to an electrical connector, and particularly to a stacked electrical connector with an internal port.

2. Description of Prior Arts

USB (Universal Serial Bus) connectors, which can transfer both high-speed signal and power, as well as IEEE 1394 connectors (FireWire connectors) are widely used to connect external devices with hosts of personal computers. Currently, USB connectors are more commonly in use, while the IEEE 1394 connectors are faster and considered to be replacements of the USB connectors in further. U.S. Pat. Nos. 5,738,544, D465,768 and 5,700,164 disclose several typical USB and/or IEEE 1394 connectors for mounting on motherboards of the personal computers, respectively.

Because of the high-speed signal and power transferring of said two kinds of connectors, USB and IEEE 1394 connectors can also be used to connect internal devices, such as floppy disk drives, CD-Rom drives and flash disk drives, with the hosts of the personal computers. Such internal USB and/or IEEE 1394 connectors for connecting with internal devices are usually to be assembled on special PCI expansion cards.

Existing motherboards normally integrate USB, even IEEE 1394, controllers, circuits and connectors therein, and the PCI expansion cards are unnecessary. However, the existing motherboards do not have internal USB and/or IEEE 1394 connectors, and assembling traditional USB and/or IEEE 1394 connectors on motherboards directly for internal using would disturb original circuit design and make trouble for a new one.

Hence, a stacked electrical connector having an internal port is desired.

SUMMARY OF THE INVENTION

An object of the present invention is to provide a stacked electrical connector having an internal port.

Another object of the present invention is to provide a stacked electrical connector having a port switch.

To achieve the above objects, an electrical connector in accordance with the present invention comprises a first port with a plurality of first terminals received therein, a second port with a plurality of second terminals received therein, a plurality of third terminals located between the first and second terminals and a moveable port switch assembled to the first and second ports. Each of said first and second terminals defines a tail portion extending outside the first and second ports, respectively. The port switch can drive the tail portions of the first and second terminals to electrically connect with the third terminals, respectively and alternately.

Other objects, advantages and novel features of the invention will become more apparent from the following detailed description of the present embodiment when taken in conjunction with the accompanying drawings.

DETAILED DESCRIPTION OF THE INVENTION

Figure 1:
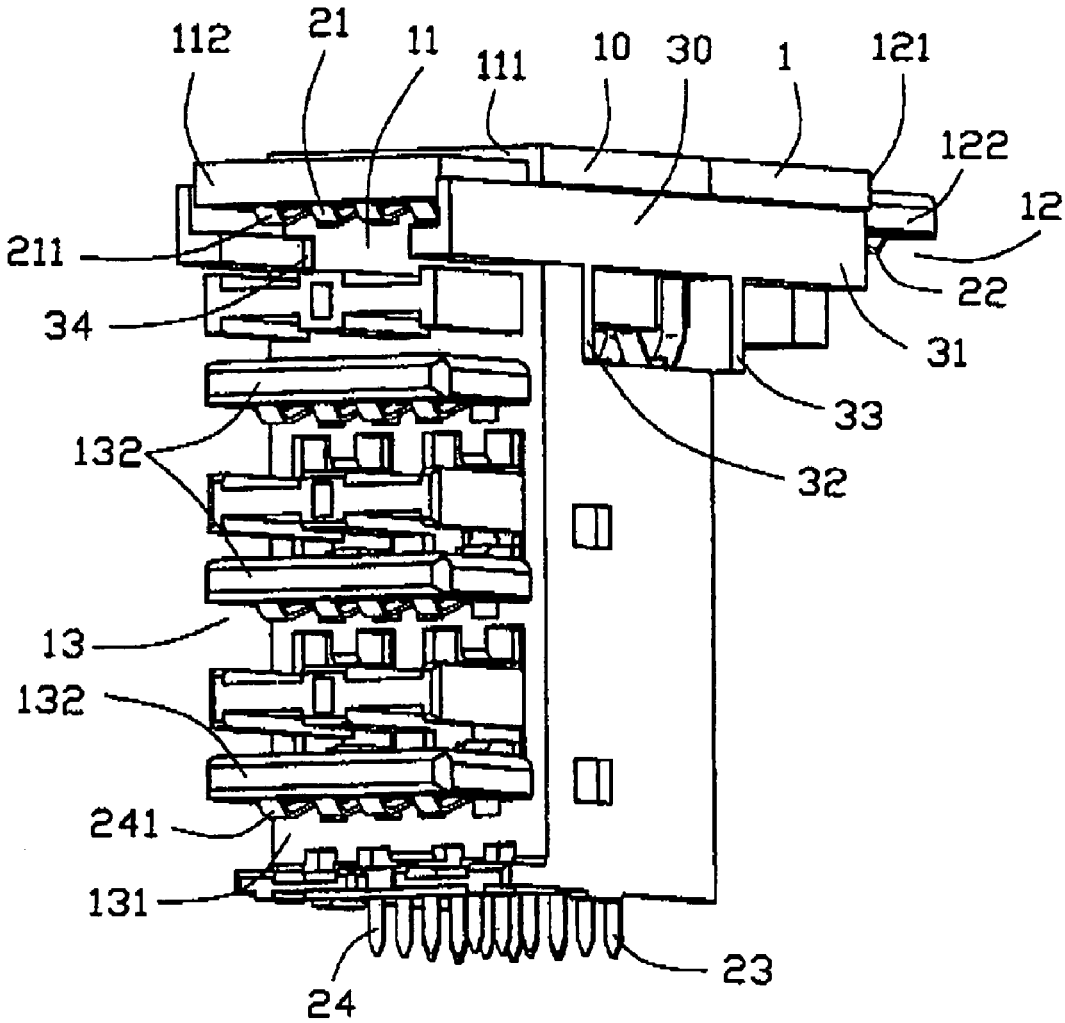
FIG. 1 is a perspective view of an electrical connector in accordance with the present invention.
Figure 2:
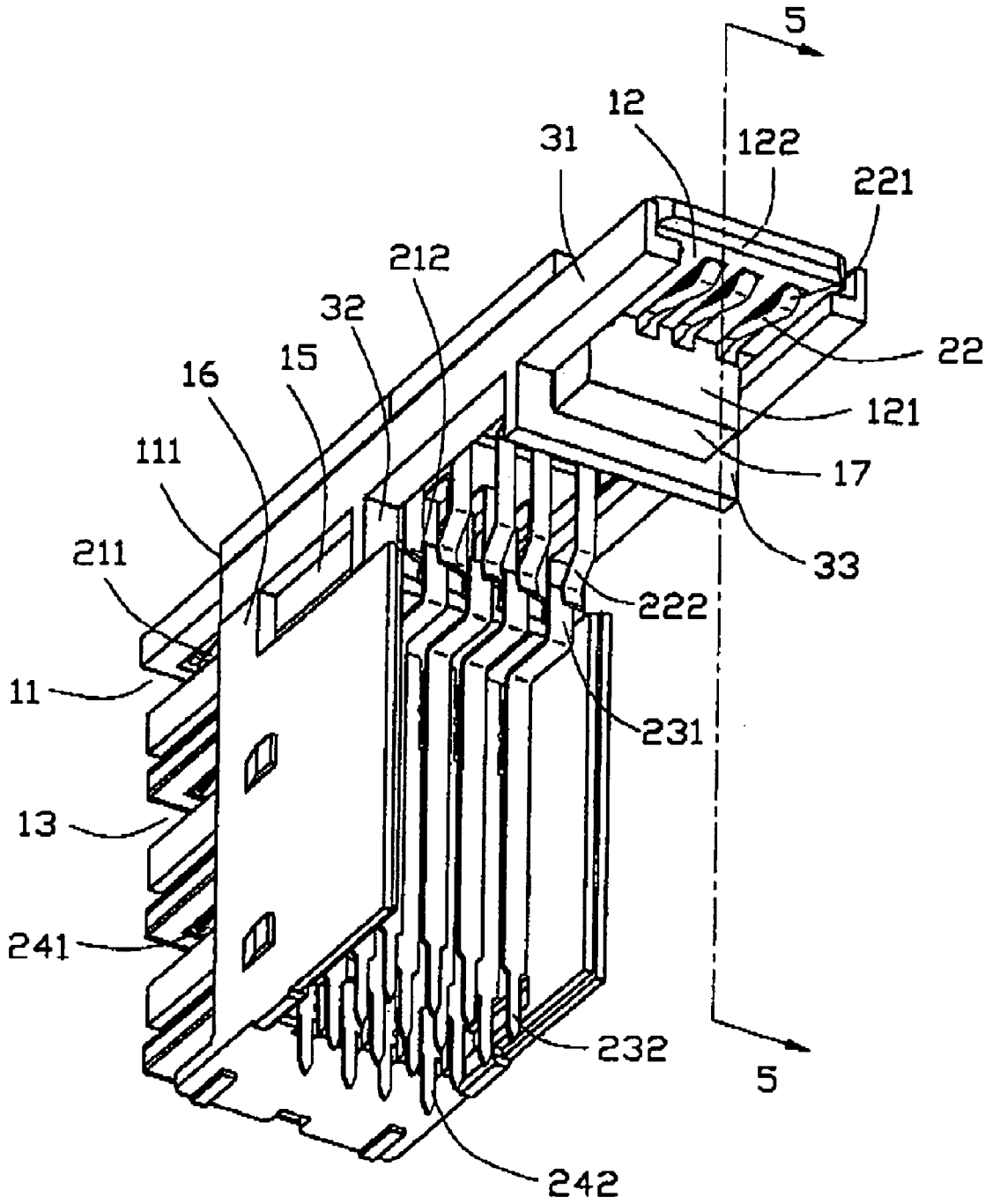
FIG. 2 is a view similar to FIG. 1, but taken from a different aspect, with the electrical connector in its first port opened condition.
Figure 3:
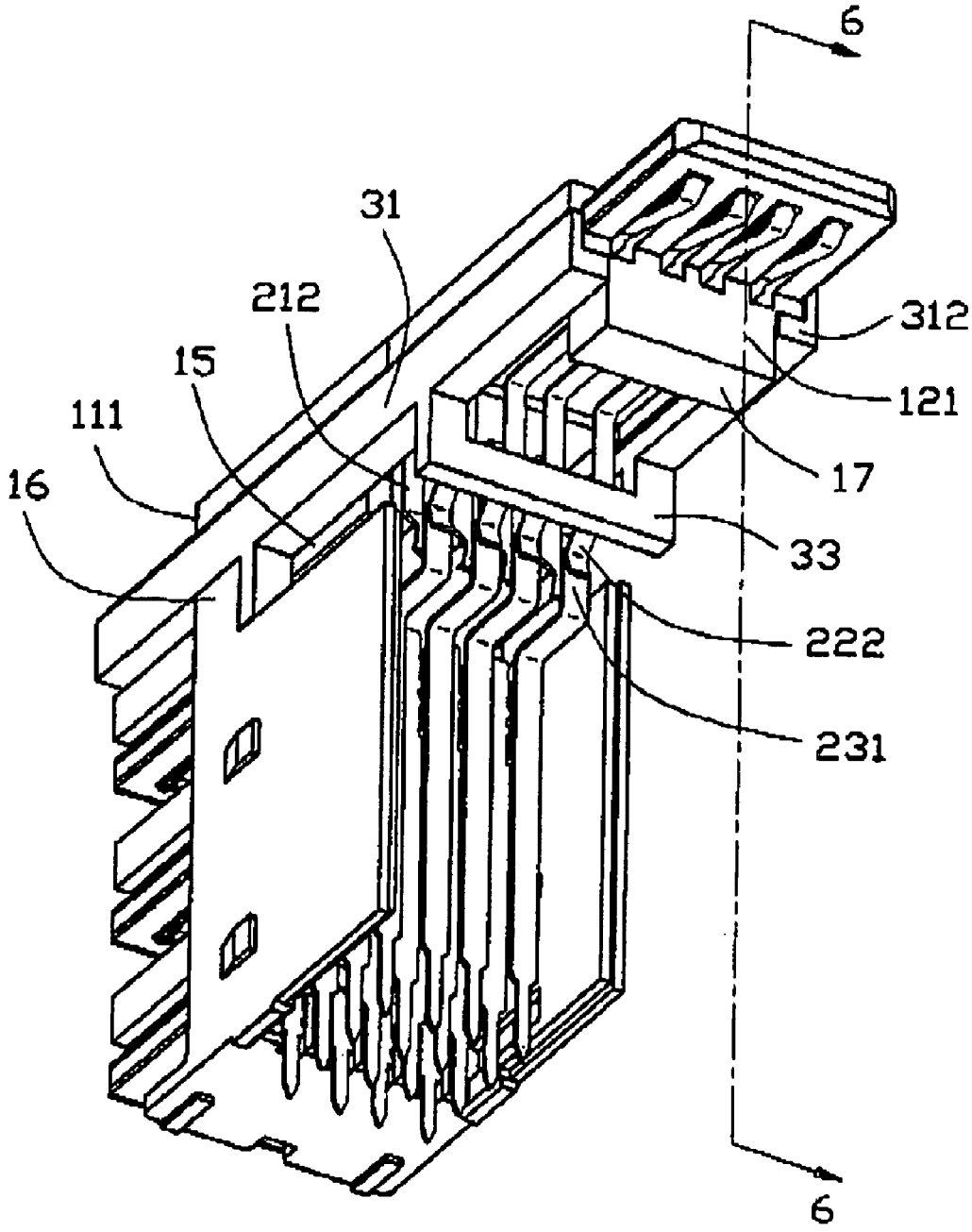
FIG. 3 is a view similar to FIG. 2, with the electrical connector in its second port opened condition.
Figure 5:
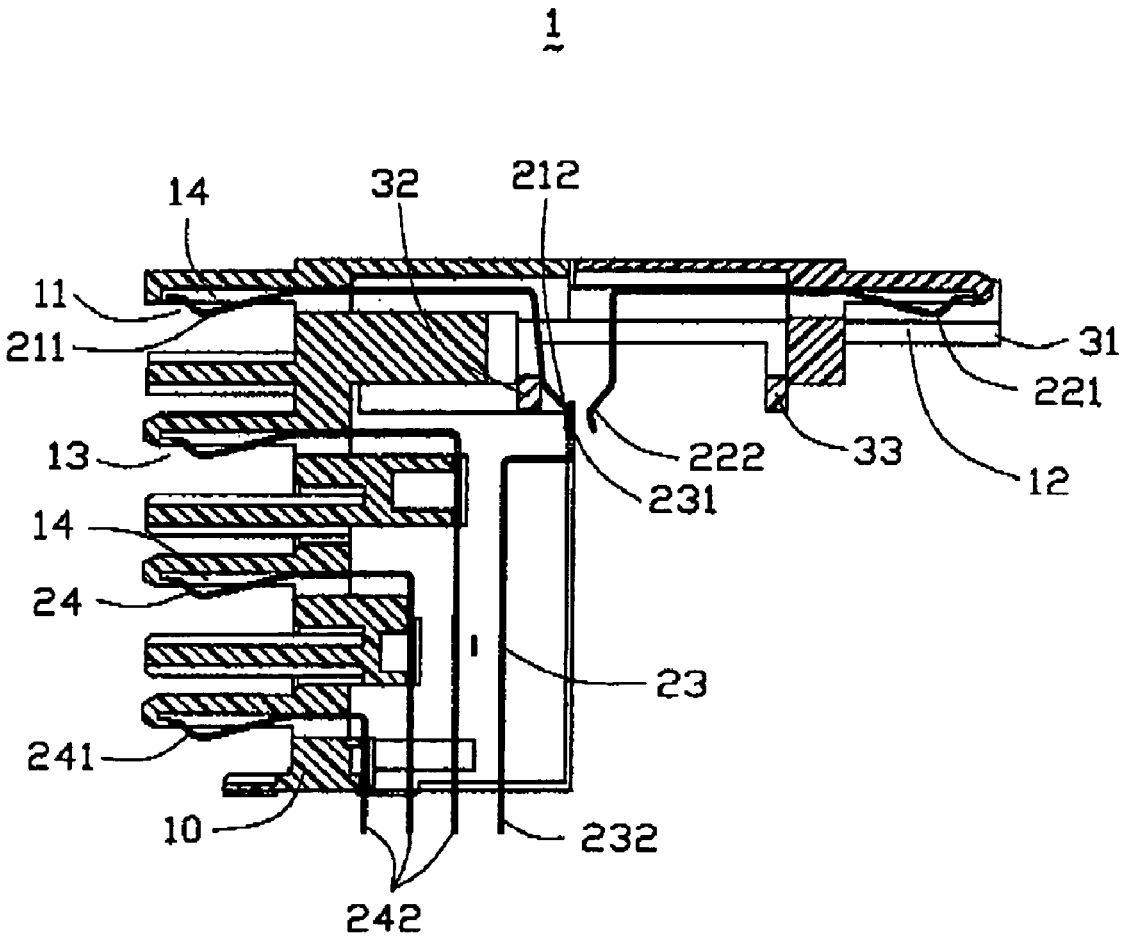
FIG. 5 is a cross-sectional view of the electrical connector of FIG. 2 taken along line 5—5.
Figure 6:
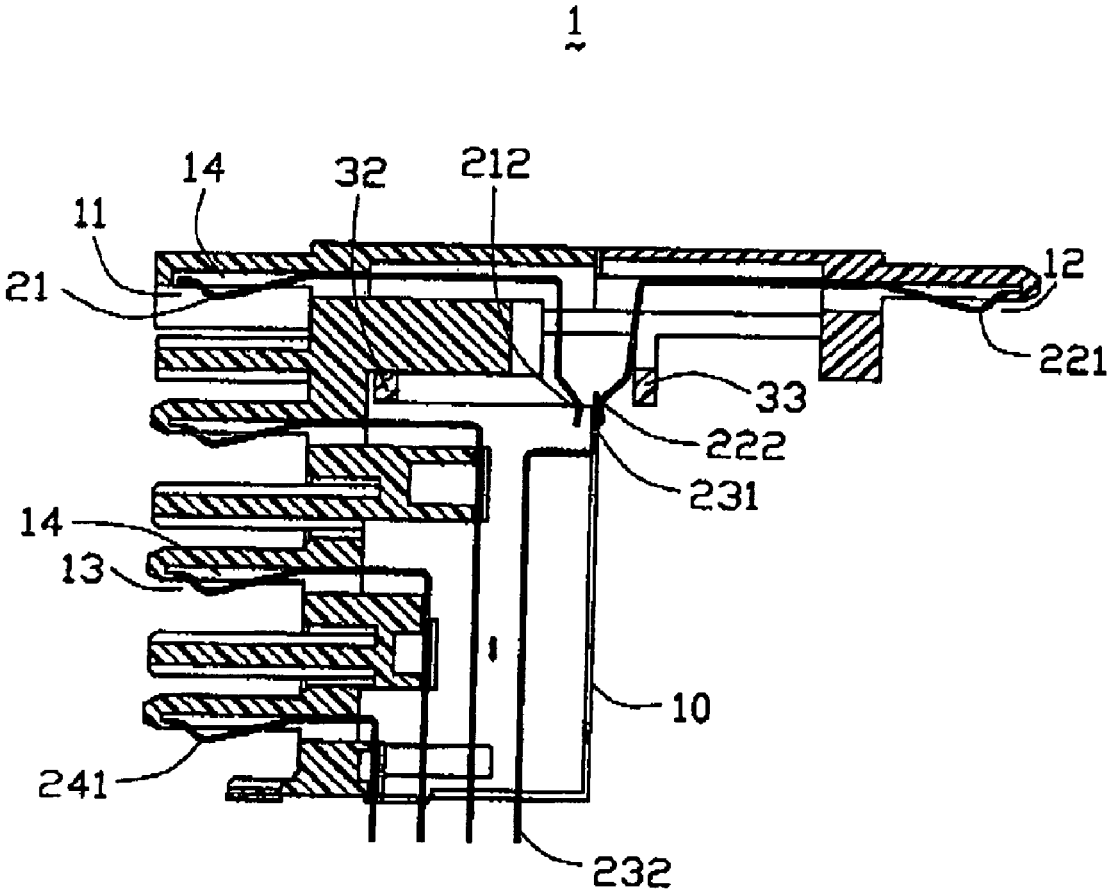
FIG. 6 is a cross-sectional view of the electrical connector of HG 3 taken along line 6—6.

Referring to FIGS. 1 to 3 and in conjunction with FIGS. 5–6, an electrical connector 1 in accordance with the present invention comprises an insularive housing 10, a plurality of L-shaped terminals 21, 22, 24 and straight terminals 23 received in the housing 10, a port switch 30, a spacer (not shown) assembled to a rear of the electrical connector 1 to ensure the straight terminals 23 in their place, and a shell (not shown) surrounding the housing 10 of the connector 1. In a preferred embodiment, the electrical connector 1 is typically a USB connector. However, in alternative embodiments, the electrical connector could be provided as other types, especially tile IEEE 1394 connector.

The insulative housing 10 comprises a first port 11, a second port 12 and a plurality of third ports 13. The first port 11 and the third ports 13 are stacked vertically in an entity and the first port 11 is located on the top of said entity. The second port 12 is assembled to a rear of the first port 11. Each of the ports 11, 12, 13 defines a mating face 111, 121, 131. The mating faces 111, 131 of the first and third ports 11, 13 face forwardly, and the mating face 121 faces rearwardly. Tongue portions 112, 122, 132 extend from the first, second and third port 11, 12, 13, respectively. The first, second and third port 11, 12, 13 further defines a plurality of passageways 14 therein. The first port 11 defines a pair of channels 15 in a front-to-rear direction and a pair of stopping portions 16 on opposite sides. The second port 12 defines a block 17 on a bottom thereof.

The first, second and fourth terminals 21, 22, 24 are received in the passageways 14 of the first, second and third ports 11, 12, 13, respectively, and the third terminals 23 are received in the spacer assembled to a rear of the electrical connector 1. Each first terminal 21 comprises a contacting portion 211 on one end thereof and a resilient first tail portion 212 on the other end thereof The contacting portion 211 extends outside the tongue portion 112 of the first port 11 for contacting with a terminal of a complementary connector (not shown). Each second terminal 22 has a structure similar to the first terminal and comprises a contacting portion 221 and a resilient second tail portion 222. Said first and second tail portions 212, 222 extend downwardly, and are separate from each other. Each third terminal 23 extending vertically, and defines a connecting portion 231 on a top end and a vertical tail portion 232 on a bottom end. The connecting portion 231 is located between corresponding first and second tail portion 212, 222. The fourth terminals 24 are received in passageways 14 of corresponding third ports 23 and each fourth terminal 24 defines a contacting portion 241 and a tail portion 242. The tail portions 232, 242 of the third and fourth terminals electrically connect with a PCB (not shown), on which the electrical connector 1 is mounted.

Figure 4:
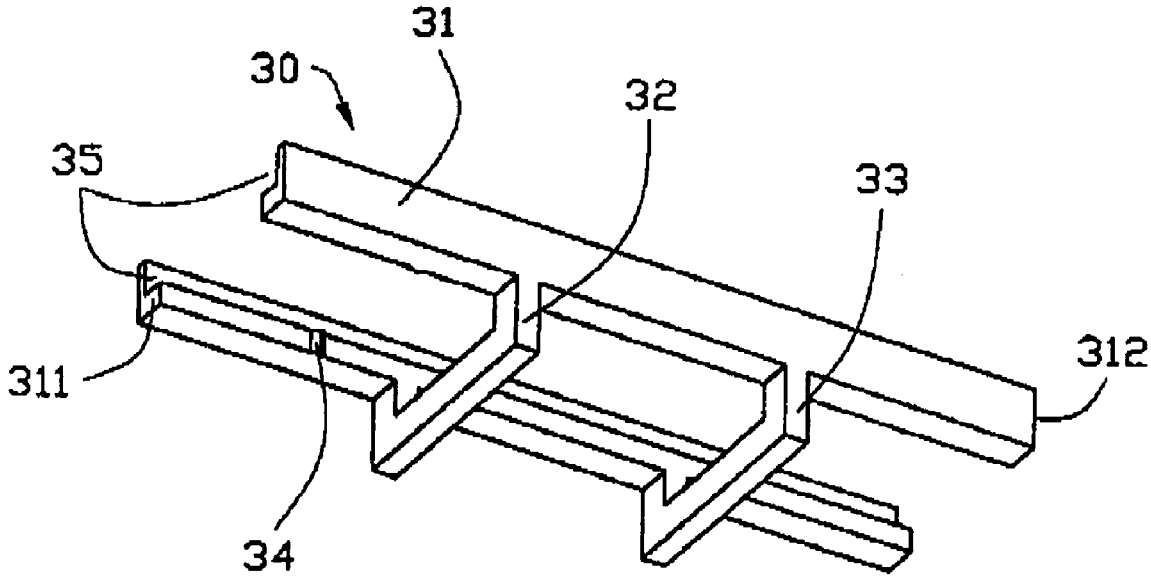
FIG. 4 is a perspective view of the port switch.

Referring to FIG. 4 and in conjunction with FIGS. 2–3 and 5–6, the port switch 30 is assembled to the first and second ports 21, 22, moveable in a front-to-rear direction and comprises a pair of opposite arms 31 extending in a front-to-rear direction, a first rib 32 and a second rib 33 parallel to and separated from each other connecting with the arms 31, respectively. The arms 31 define a front 311 and rear 312. The front portion of the port switch 30 is received in corresponding channels 15 and the spacer supports the rear portions of the port switch 30. Each of the opposite arms 31 defines a slot 35 for ensuring the assembly of the port switch 30. The arms 31 further define a pair of opposite protrusions 34. The first rib 32 is located forward to the first tail portions 212, and the second rib 33 is located rear to the second tail portions 222. The shell is surrounding the electrical connector 1.

Referring to FIGS. 2 and 5, in use, when the first port 11 mates with the complementary connector, the complementary connector abuts against the front 311 of the arms 31 to drive the port switch 30 to move rearwardly, and finally the first rib 32 pushes against the first tail portions 212 to electrically connect with corresponding connecting portions 231. Meanwhile, the block 17 of the second port 12 stops further rearward movement of the port switch 30 by its blocking to the second rib 32, and the rears 312 of the arms 31 explode beyond the tongue portion 122 of the second port 12 in the front-to-rear direction for preventing the second port 12 from being mistakenly coupled with other complementary connectors 2. As shown in FIGS. 3 and 6, when the second port 12 mates with the complementary connector and the first port 11 is unused, the complementary connector abuts against the rear 312 of the arms 31 to drive the port switch 30 forwardly and meanwhile the first tail portions 212 disconnect from the connecting portions 231 because of the resilience thereof. Finally the second rib 33 pushes against the second tail portions 222 to electrically connecting with corresponding connecting portions 231. Meanwhile the stopping portions 16 stop further front movement of the port switch 30 by abutting against the first rib 32, and the arms 31 explode beyond the tongue portion 112 of the second port 12 in the front-to-rear direction for preventing the second port 12 from being mistakenly coupled with other complementary connectors 2. The protrusions 34 engage with the mating face 111 for retaining the port switch 30 to avoid miss mating of the exploded arms 31. As detailed description above, the first port 11 and the second port 12 are mutually exclusively used with corresponding complementary connector by means of the port switch 30.

Figure 8:
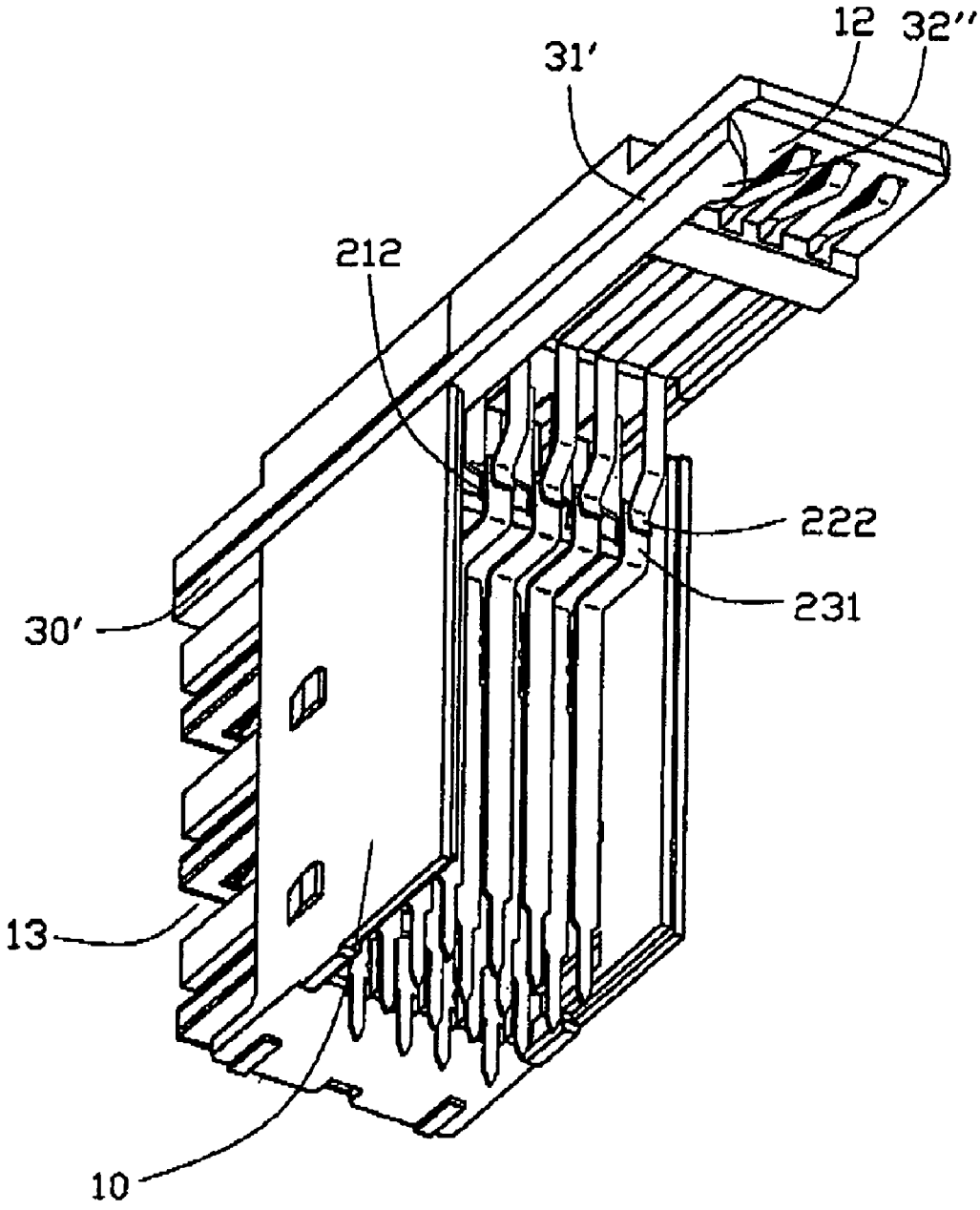
FIG. 8 is a perspective view of an electrical connector with a another type port switch in accordance with the present invention.
Figure 9:
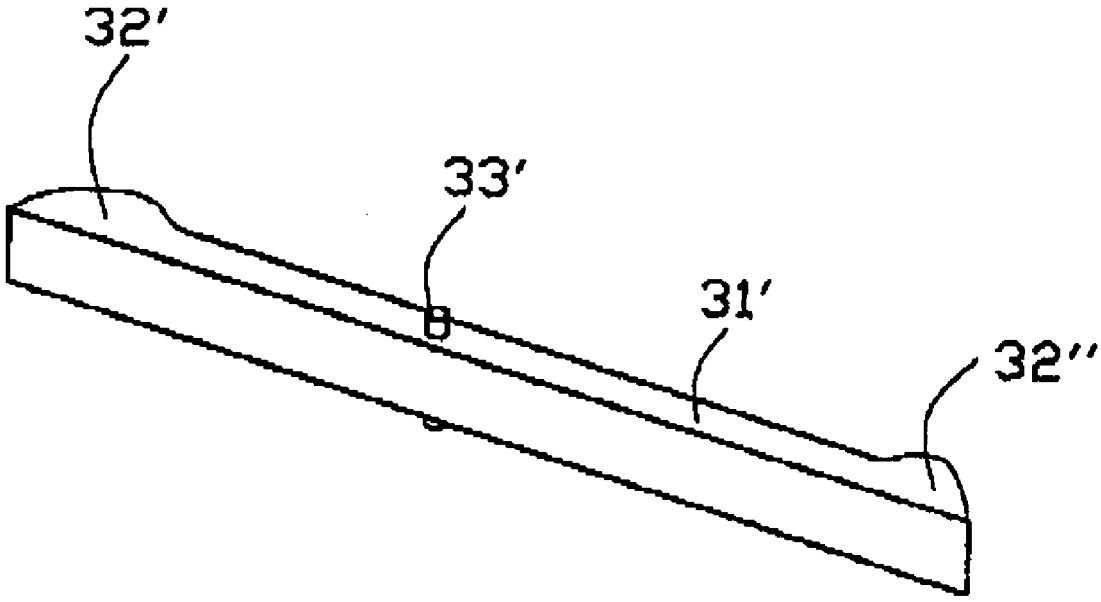
FIG. 9 is a perspective view of another type port switch in FIGS. 7 and 8.

FIGS. 8–9 shown a pivotal/lover type port switch 30' replacing the port switch 30 to work with the first and second ports 21 and 22. The pivotal type port switch 30' is essentially disclosed on one lateral side of the housing 10 and includes an elongate arm 31' with protrusions 32' and 32" at two opposite ends and with pivots 33' on the middle portion. Understandably, the corresponding housing 10 requires to be modified to form a pair of pivot holes (not shown) in the lateral face of the housing to support the pivotal type port switch 30' so as to have the pivotal type port switch 30' pivotable relative to the housing 10 about the pivot 33' which extends in the vertical direction of the housing. When the rear/inner port 12 is mated with the mated with the complementary connector will engage the rear protrusion 32" to bring about rotation of the pivotal type port switch 30', thus resulting in the front protrusion 32' invading/blocking the front/outer port 11. It should be noted that in the pivotal type port switch embodiment, the tail Portion 212 of the terminals 21 and the tail portion 222 of the terminals 22 are constantly engaged with the connecting Portion 231 of the corresponding terminals 23, respectively, as shown in the FIGS. 8, disregarding whether the port 11/12 is used or not.

Figure 7:
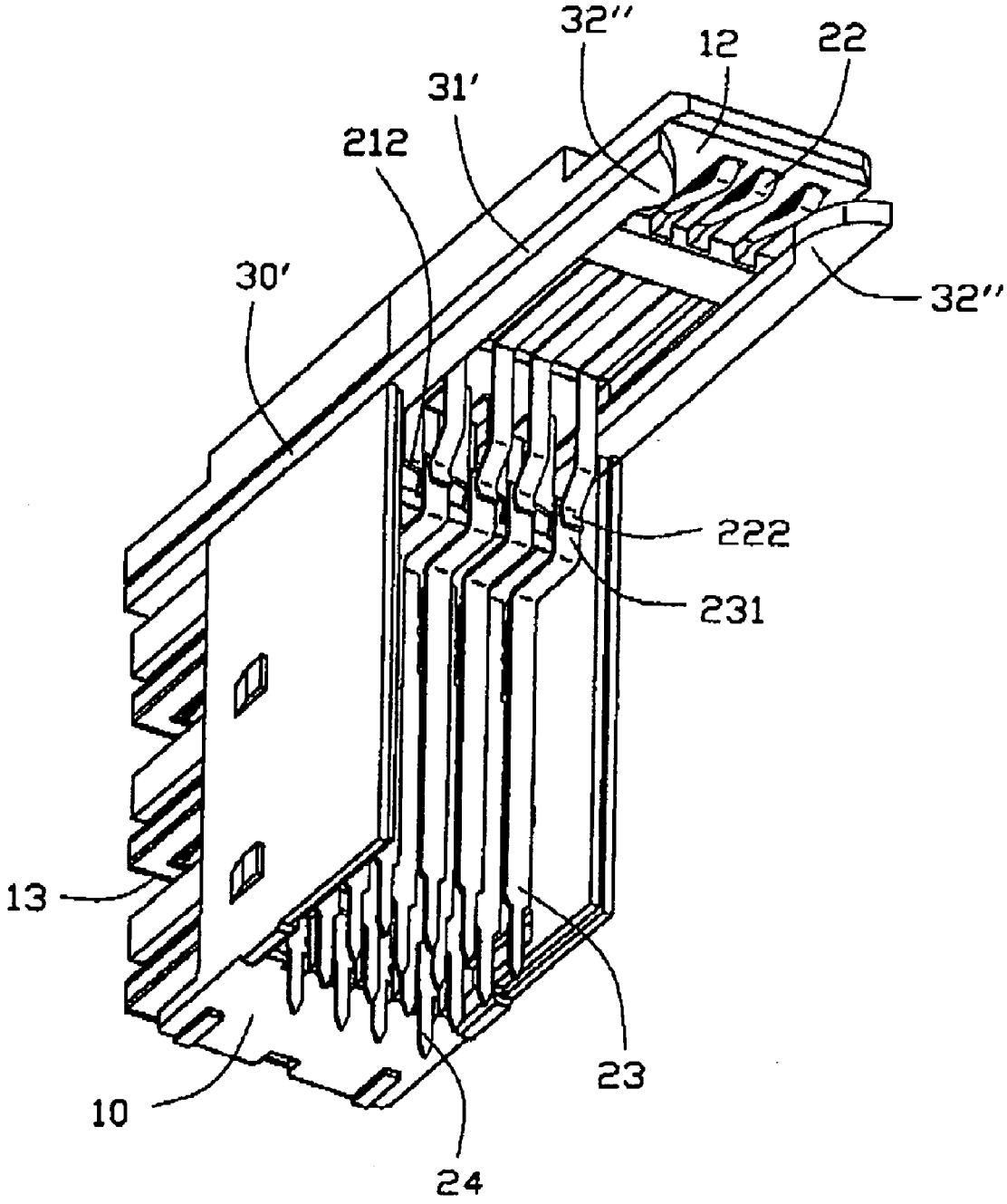
FIG. 7 is a perspective view of an electrical connector with a pair of another type port switch in accordance with the present invention.

Optionally, referring to FIG. 7, another pivotal type port switch may be provided on the other lateral side of the housing opposite to the pivotal type port switch 30' in an mirror image arrangement so as to have the whole structure of the connector assembly in a more symmetrical manner Furthermore, as well known, it is optimal to equip the pivotal type port switch 30' with a torsion spring to have the front protrusion 32' always leave the front/outer port 11 if the rear/inner port is not used. This will give the user a clear indication that the front/outer port 11 is ready for use. Similarly, the linear type port switch 30 in the first embodiment can be equipped with a spring tang to urge the linear type port switch 30 to be always in a rear position to leave the front/outer port open, if the rear/inner port 12 in not used, for indication of availability of usage of the front/outer port 11. It is also noted that in both the embodiments, the port switch 30/30' is essentially in a biased/titled position rather than a neutral position relative to the housing when one of the complementary connector is used with the one of the corresponding inner/outer ports 11/12.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector for mating with a complement connector, comprising:

at least one first port;

a plurality of first terminals received in the at least one first port, each first terminal defines a resilient first tail portion;

a second port;

a plurality of second terminals received in the second port, each second terminal defines a resilient second tail portion;

a plurality of third terminals located between the first and second terminals; and a port switch; wherein when the first port mates with the complementary connector, the complementary connector drives the port switch to push the first tail portions of first terminals to electrically connecting with the third terminals, when the second port mates with the complementary connector, the complementary connector drives the port switch to push the second tail portions of second terminals to electrically connecting with the third terminals.

2. The electrical connector as described in claim 1, wherein the first purr and the second port extend along opposite directions.

3. The electrical connector as described in claim 2, wherein each of the first and second tail portions extends downwardly, and each third terminal defines a connecting portion between corresponding first and second tail portions.

4. The electrical connector as described in claim 3, wherein the port switch is moveable in a front-to-rear direction and comprises a pair of opposite arms extending in a front-to-rear direction, a first rib and a second rib parallel to and separated from each other connecting with the arms, respectively.

5. The electrical connector as described in claim 4, wherein when the switch port move rearward, die first rib can push the first tail portions of the first terminals to electrical connect with the connecting portions of the third terminals a meanwhile the second tail portions of the second terminals disconnect from the connecting portions of the third terminals, and when the switch port move rearward, the second rib can push the second tail portions of the second terminals to electrical connect with the connecting portions of the third terminals and meanwhile the first tail portions of the first terminals disconnect from the connecting portions of the third terminals.

6. The electrical connector as described in claim 1, wherein the port switch defines a pair of opposite protrusions on the opposite pair of arms thereof respectively, when the port switch was derived by the complementary connector to push the second tail portions to connect with the third terminals, the protrusions engaging with the first port for retaining the port switch.

7. The electrical connector as described in claim 1, further comprising a plurality of third ports and a plurality of fourth terminals received in the third ports, the first port and the third ports are stackedly arranged.

8. The electrical connector as described in claim 1, wherein the first port defines a pair of channels, and the port switch is received in the channels.

9. The electrical connector as described in claim 1, wherein the first port defines a pair of stopping portions and the second port defines a block, and the port switch is moveable between the stopping portions and the block.

10. The electrical connector as described in claim 1, further comprising a spacer assembled to a rear of the electrical connector supporting a rear portion of the port switch.

11. The electrical connector as described in claim 1, further comprising a shell surrounding the ports.

12. An electrical connector comprising:

an insulative housing assembly defining opposite inner and outer mating ports at two opposite ends in a lengthwise axis along which inner and outer complementary connectors are mated with the corresponding mating ports, respectively;

a first set of contacts disposed in the first mating port;

a second set of contacts disposed in the second mating port;

a port switch positioned around the housing including an elongated arm essentially extending along said lengthwise axis with two opposite engagement blocks at two opposite ends thereof, said two opposite engagement blocks being movable in the corresponding inner and outer mating ports, respectively; wherein when one of said inner and outer mating ports is coupled with one of said complementary connectors, the corresponding engagement block in said one of the inner and outer mating ports is urged by said one complementary connector to activate the port switch, thus resulting in the other engagement block blocking the other of the inner and outer putting ports for preventing the other of the said inner and outer mating ports from being mistakenly coupled with the other of said complementary connectors.

13. The electrical connector as claimed in claim 12, wherein said port switch is linearly moved relative to the housing.

14. The electrical connector as claimed in claim 12, wherein said port switch is pivotally moved relative to the housing.

15. The electrical connector assembly as claimed in claim 12, wherein the outer mating port is always in an open manner for indication of availability of usage, if the inner mating port is not used.

16. The electrical connector as claimed in claim 12, wherein both said first set of contacts and said second set of contacts are engaged with a third set of contacts for connecting to a printed circuit board on which the housing is mounted.

17. An electrical connector comprising:

an insulative housing assembly defining opposite inner and outer mating ports at two opposite ends in a lengthwise axis along which inner and outer complementary connectors are mated with the corresponding mating ports, respectively:

a first set of contacts disposed in the first mating port;

a second set of contacts disposed in the second mating port;

a port switch positioned around the housing including an elongated arm essentially extending along said lengthwise axis with two opposite engagement blocks at two opposite ends thereof, said two opposite engagement blocks being movable in the corresponding inner and outer mating ports, respectively; wherein said inner mating port and said outer mating port are mutually exclusively used with correspond complementary connectors by means of said port switch.

18. The electrical connector as claimed in claim 17, wherein said port switch is in a biased position when one of said mating ports is used with the complementary connector.

19. The electrical connector as claimed in claim 17, wherein said port switch is linearly moved relative to the housing.

20. The electrical connector as claimed in claim 17, wherein said port switch is pivotal moved relative to the housing.

* * * * *